US006148475A

United States Patent [19]

Stross

[11] Patent Number: 6,148,475

[45] Date of Patent: Nov. 21, 2000

[54] VACUUM CLEANER WITH VIBRATING BRUSHES

[75] Inventor: Thomas W. Stross, North Royalton, Ohio

[73] Assignee: The Scott Fetzer Company, Westlake, Ohio

[21] Appl. No.: 09/328,276

[22] Filed: Jun. 8, 1999

[51] Int. Cl.[7] ..... A47L 9/04

[52] U.S. Cl. ..... 15/381; 15/380

[58] Field of Search ..... 15/380, 381, 382, 15/385

[56] References Cited

U.S. PATENT DOCUMENTS

| | | | |
|---|---|---|---|
| 1,925,350 | 9/1933 | Tucker | 15/382 |
| 2,096,517 | 10/1937 | Hurley | 15/382 |
| 2,202,989 | 6/1940 | Kitto | 15/382 |
| 2,233,252 | 2/1941 | Eckert | 15/382 |
| 2,238,917 | 4/1941 | Smellie | 15/364 |
| 2,537,523 | 1/1951 | Frost | 55/334 |
| 2,571,647 | 10/1951 | Adams | 15/381 |
| 2,581,794 | 1/1952 | Hodges | 15/364 |
| 2,825,925 | 3/1958 | Acheson | 15/354 |
| 3,002,217 | 10/1961 | Smithson et al. | 15/382 |
| 3,054,131 | 9/1962 | Groves | 15/382 |
| 3,276,066 | 10/1966 | Chiba | 15/352 |
| 3,329,989 | 7/1967 | Smith et al. | 15/382 |
| 3,711,891 | 1/1973 | Conway | 15/321 |
| 3,754,299 | 8/1973 | Turner | 15/380 |
| 3,805,319 | 4/1974 | Evans et al. | 15/380 |
| 3,931,662 | 1/1976 | Nayfa et al. | 15/380 |
| 4,272,861 | 6/1981 | Notta et al. | 15/381 |
| 4,408,366 | 10/1983 | Goldsmith | 15/321 |
| 4,430,768 | 2/1984 | Novinger | 15/381 |
| 5,901,411 | 5/1999 | Hato et al. | 15/381 |

*Primary Examiner*—Robert J. Warden, Sr.
*Assistant Examiner*—Theresa T. Snider
*Attorney, Agent, or Firm*—Watts, Hoffman, Fisher & Heinke, Co., L. P. A.

[57] ABSTRACT

A vacuum floor cleaning system is provided having a carpet fiber agitating brush which oscillates in a plane horizontal to the floor. The vacuum floor cleaning system of the present invention includes generally a base member supported above the floor by wheels. The base member defines a nozzle opening positioned in close proximity to the floor and an air flow path between the nozzle and a dirt accumulation container. The base member serves as a mounting container for an electric motor, a suction producing fan, and a carpet fiber agitating brush bar.

The electric motor is mounted to a motor baseplate in the base member and drives a rotating motor shaft which protrudes from a motor housing. The suction fan is mechanically coupled to and rotatably driven by the motor shaft to produce an air flow along the air flow path from the floor to the dirt accumulation container. A carpet fiber agitating brush bar including a plurality of brush bristles positioned within the nozzle opening is moveably supported in the base member by an agitator suspension member and is coupled to the motor shaft by an agitation transmission comprising a transmission disc having a brush bar drive shaft mounted eccentrically with respect to the motor shaft. The motor shaft drives the agitation transmission to impart limited eccentric movement to the carpet agitating brush bar within a plane parallel to the floor.

4 Claims, 4 Drawing Sheets

VACUUM CLEANER WITH VIBRATING BRUSHES

TECHNICAL FIELD

The invention concerns vacuum cleaning systems for floors and floor coverings. More particularly, the invention concerns a vacuum cleaner having fiber agitating brushes which move in a plane parallel to the floor.

BACKGROUND OF THE INVENTION

Many commercially available vacuum cleaners combine suctioning and carpet fiber agitation to clean carpets. Brush rolls and beater bars are common means of agitating carpet fibers. The bristles or beater bars of brush rolls are used to agitate carpet fibers to loosen dirt to be removed by the suction of a vacuum producing fan. However, the use of brush rolls entails many disadvantages caused by the harshness with which they engage the carpet surface. In order to clean a carpet, it is only necessary to vibrate the fibers to loosen dirt and excessive pounding or grinding of the carpet fibers may be counterproductive in terms of both cleaning and carpet wear. For example, the rotating friction producing motion of brush roll bristles and the pounding motion of beater bars may actually push dirt deeper into the carpet where it cannot be removed by the vacuum. In addition, the pounding motion of the beater bar and the fiber pulling rotation of brush roll bristles wear the carpet. Some vacuum cleaners which incorporate brush rolls are not recommended for use on bare floors such as hardwood or linoleum because they may damage unprotected floors.

The use of brush rolls increases the cost of a sweeper. The brush roll is one of the most costly parts of a sweeper. In addition to their expense, brush rolls and their attending parts such as belts, bristle fiber and bearings tend to wear out before other components of the vacuum cleaner. The conventional use of brush rolls and beater bars increases the height of the motor housing of the sweeper. Because of their housing height most sweepers with brush rolls and beater bars can be moved only a limited distance under furniture.

SUMMARY OF THE INVENTION

An object of the present invention is to provide a vacuum floor cleaning system having a means of agitating carpet fibers which improves cleaning and reduces carpet wear.

A more particular object of the invention is to provide a vacuum floor cleaning system having a new carpet fiber agitating brush bar which moves in a plane horizontal to the floor to agitate the carpet fibers without pushing them down. The horizontal movement of the brush bar allows the brush bristle fibers to penetrate into the carpet fibers to loosen dirt trapped below the surface without imbedding dirt into the carpet by pounding the carpet. The horizontal movement of the brush bar reduces carpet wear by penetrating the fibers without pulling at the carpet fibers.

Another object of the present invention is to provide a vacuum floor cleaning system having a new carpet fiber agitating brush bar which reduces the overall cost of the cleaning system by eliminating the need for brush rolls and their supporting hardware while providing superior cleaning and carpet wear and machine wear characteristics. Reliability of the sweeper is enhanced due to the reduced number of components.

The vacuum floor cleaning system of the present invention comprises generally a base member supported above the floor by wheels. The base member defines a nozzle opening positioned in close proximity to the floor and an air flow path between the nozzle and a dirt accumulation means. The base member serves as a mounting means for an electric motor, a suction producing fan, and a carpet fiber agitating brush bar.

The electric motor is mounted to a motor baseplate in the base member and drives a threaded, rotating motor shaft which protrudes from a motor housing. The suction fan is mechanically coupled to and rotatably driven by the motor shaft to produce an air flow along the air flow path from the floor to the dirt accumulation means.

In an embodiment of the present invention, a carpet fiber agitating brush bar comprising a plurality of brush bristle fibers positioned within the nozzle opening is moveably supported in the base member by an agitator suspension means and is coupled to the motor shaft by an agitation transmission which imparts limited eccentric movement to the carpet agitating brush bar within a plane parallel to the floor.

The base member comprises a cleaner housing and a floor plate. The axis of rotation of the motor and the motor shaft is perpendicular to the floor, and the agitation transmission is directly driven by the motor shaft. The agitation transmission comprises a motor shaft engaging means. The motor shaft engaging means threads on to the threads of the motor shaft and carries an agitation shaft eccentrically mounted with respect to the motor shaft which engages the carpet fiber agitating brush bar to impart limited eccentric movement to the brush bar within a plane parallel to the floor. The agitator suspension means comprises a spring.

In another embodiment of the present invention, a carpet fiber agitating brush bar comprising a plurality of brush bristles positioned within the nozzle opening is pivotally supported in the base member by a pivot and suspension spring. An electromagnetic coil produces an oscillating magnetic field which acts on an armature mounted to the end of the brush bar opposite the brush bristles. The action of the coil on the armature causes the brush bar to pivot about the pivot spring to vibrate the brush bristles in a plane horizontal to the floor.

The electromagnetic coil may be connected to the alternating current which powers the sweeper motor. As the current cycles, so does the magnetic field. The armature may be contained between two travel limiting springs and is attracted to and then released from the electromagnetic coil to produce the vibrating motion of the brush bristles located at the other end of the brush bar.

Other objects and advantages and a fuller understanding of the invention will be had from the following detailed description of the preferred embodiments and the accompanying drawings.

DETAILED DESCRIPTION OF THE PREFERRED EMBODIMENT

Figure 1:
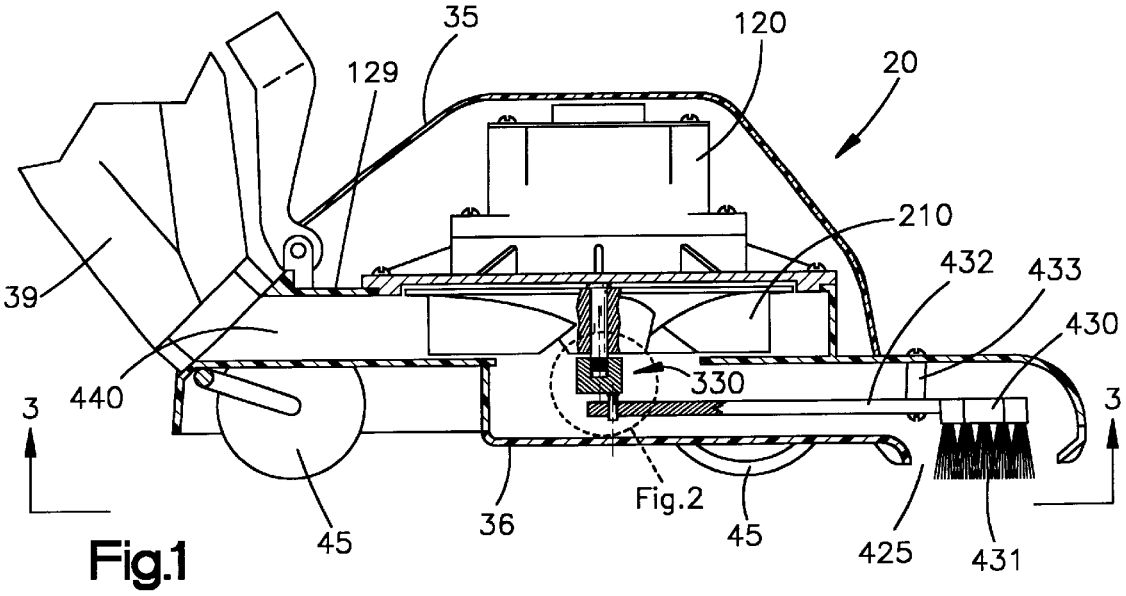
FIG. 1 is a section view of a vacuum cleaning system in accordance with one embodiment the present invention.

Referring now to the drawings, and to FIG. 1 in particular, a vacuum cleaning system in accordance with an embodiment of the present invention is designated by reference character 20. The cleaning system is enclosed by a cleaner housing 35 connected to a floor plate 36. A plurality of wheels 45 support the system 20 above a floor to be cleaned. A dirt accumulating bag 39 may be mounted on the cleaner housing 35 to collect dirt removed from the floor by the cleaning system.

The cleaner housing 35 and the floor plate 36 define an air flow path 440 between the accumulating bag 39 and the floor. A nozzle 425 positioned near the floor is also defined by the cleaner housing 35 and the floor plate 36 and forms an opening to the air flow path 440. The cleaner housing 35 and the floor plate 36 enclose a motor 120, a suction producing fan 210, a carpet fiber agitating brush bar 432, and a brush bar transmission 330.

The motor 120, which may be a pancake type motor, is mounted to a motor baseplate 129 within the cleaner housing 35. A motor shaft 125 having a threaded end 126 protrudes from the motor 120 (shown in FIG. 2). The axis of rotation of the motor 120 and its motor shaft 125 is perpendicular to the floor.

The suction producing fan 210 is mounted to and driven by the motor shaft 125. The fan 210 pulls air through the nozzle 425 and directs the air through the air flow path 440 into the dirt accumulating bag 39. The motor shaft protrudes through the fan 210 and is threadably coupled to the brush bar transmission 330.

Figure 2:
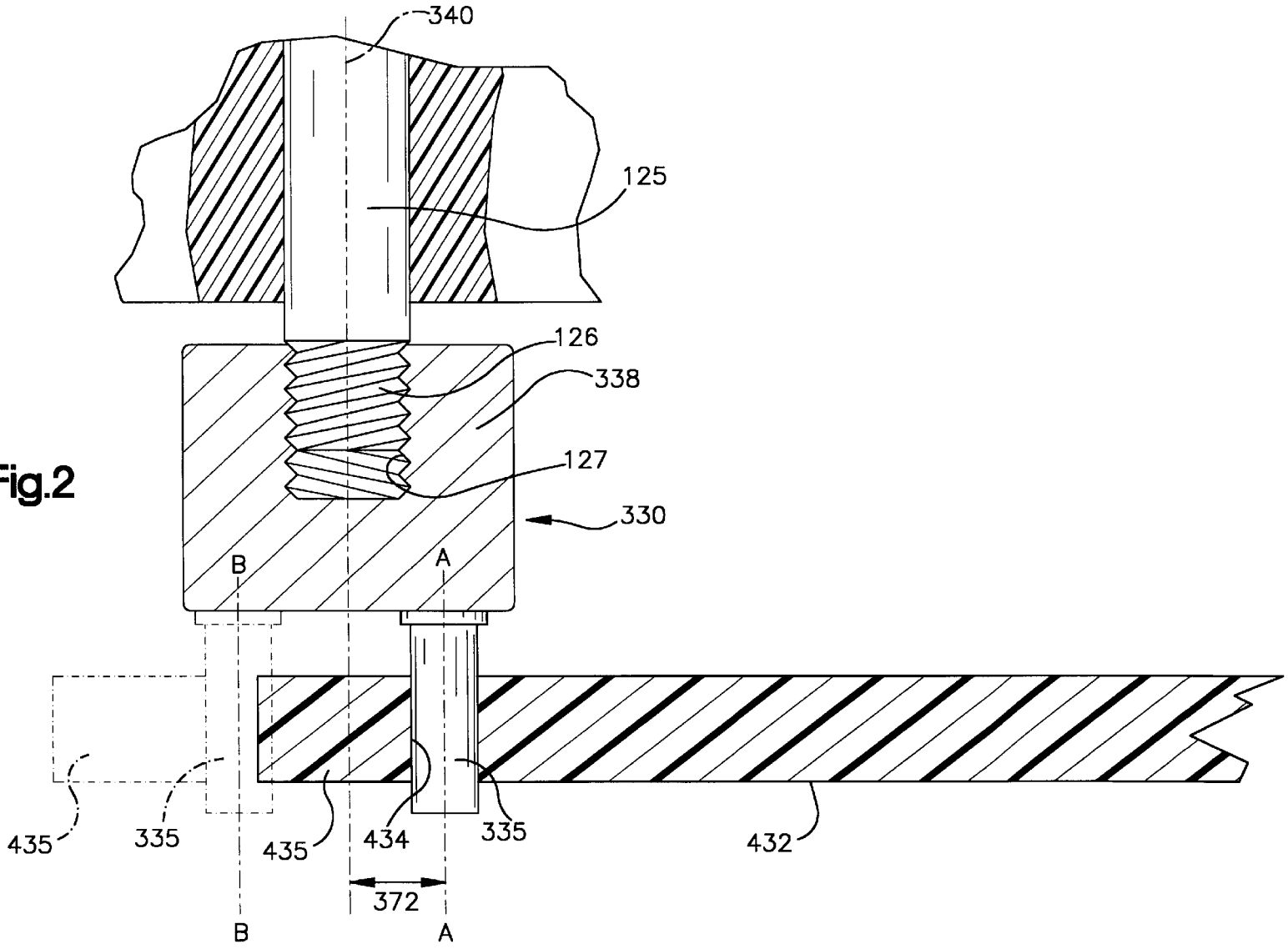
FIG. 2 is a fragmentary, enlarged section view of an agitation means transmission in accordance with the present invention.

Referring now to FIG. 2, the brush bar transmission 330 generally comprises a transmission disc 338 having an interior threaded cavity 127 at a top end for coupling with the threaded end 126 of the motor shaft and a brush bar drive shaft 335 at a bottom end. The brush bar drive shaft 335 protrudes from the transmission disc 338 at a first disc radius 372 which is offset from the axis of rotation of the motor and transmission disc 340.

Figure 3:
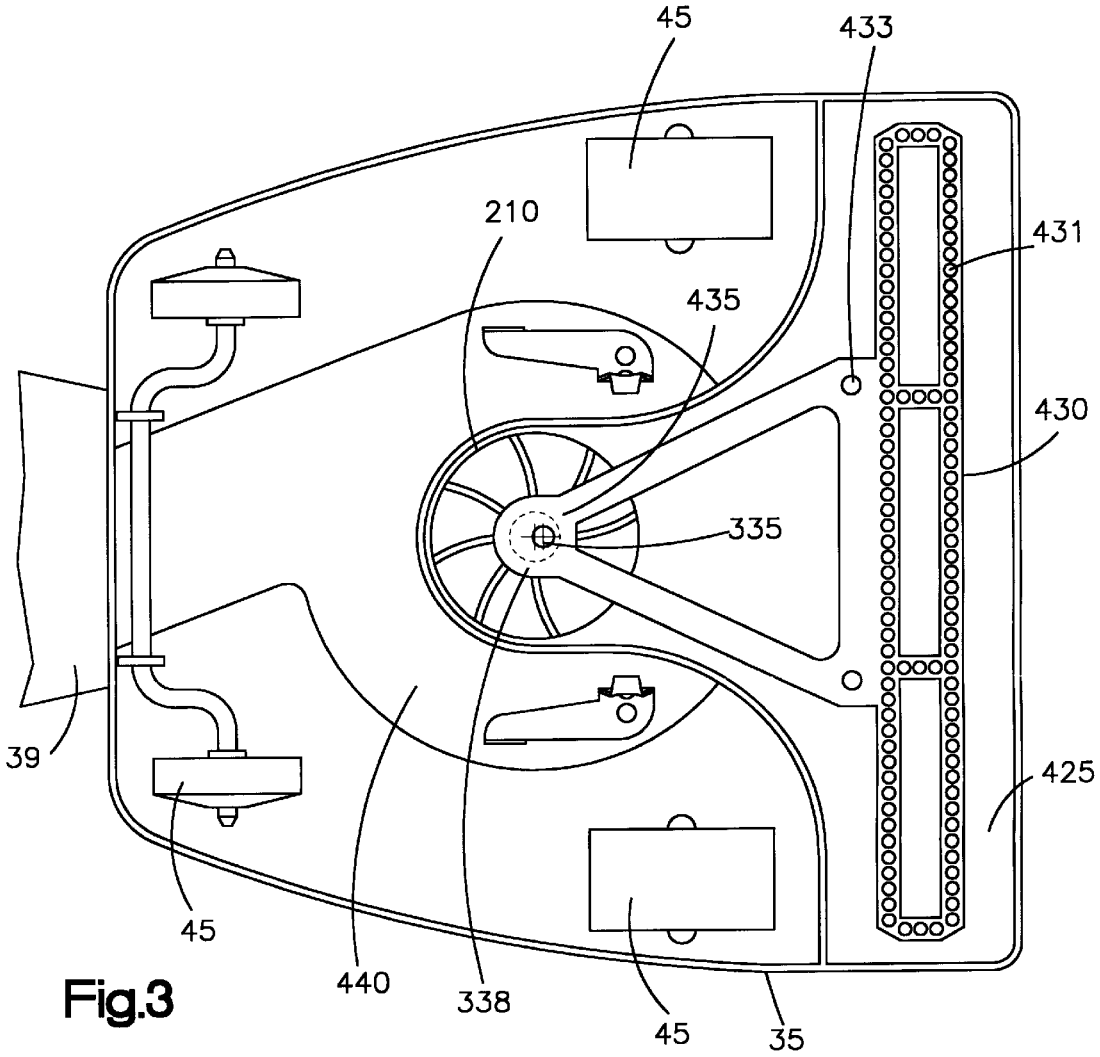
FIG. 3 is a bottom plan view of the vacuum cleaning system of FIG. 1.

The brush bar 432 has a first brush bar end 430 (FIG. 1) and a second brush bar end 435. A brush block 431 is disposed at the first brush bar end 430. The first brush bar end is moveably connected to the cleaner housing 35 within the nozzle 425 by an agitator spring 433 so that the brush block 431 contacts the floor. When the fan 210 is operating, air is sucked through the nozzle 425 and the brush block 431 as can be seen in FIG. 3.

Figure 4:
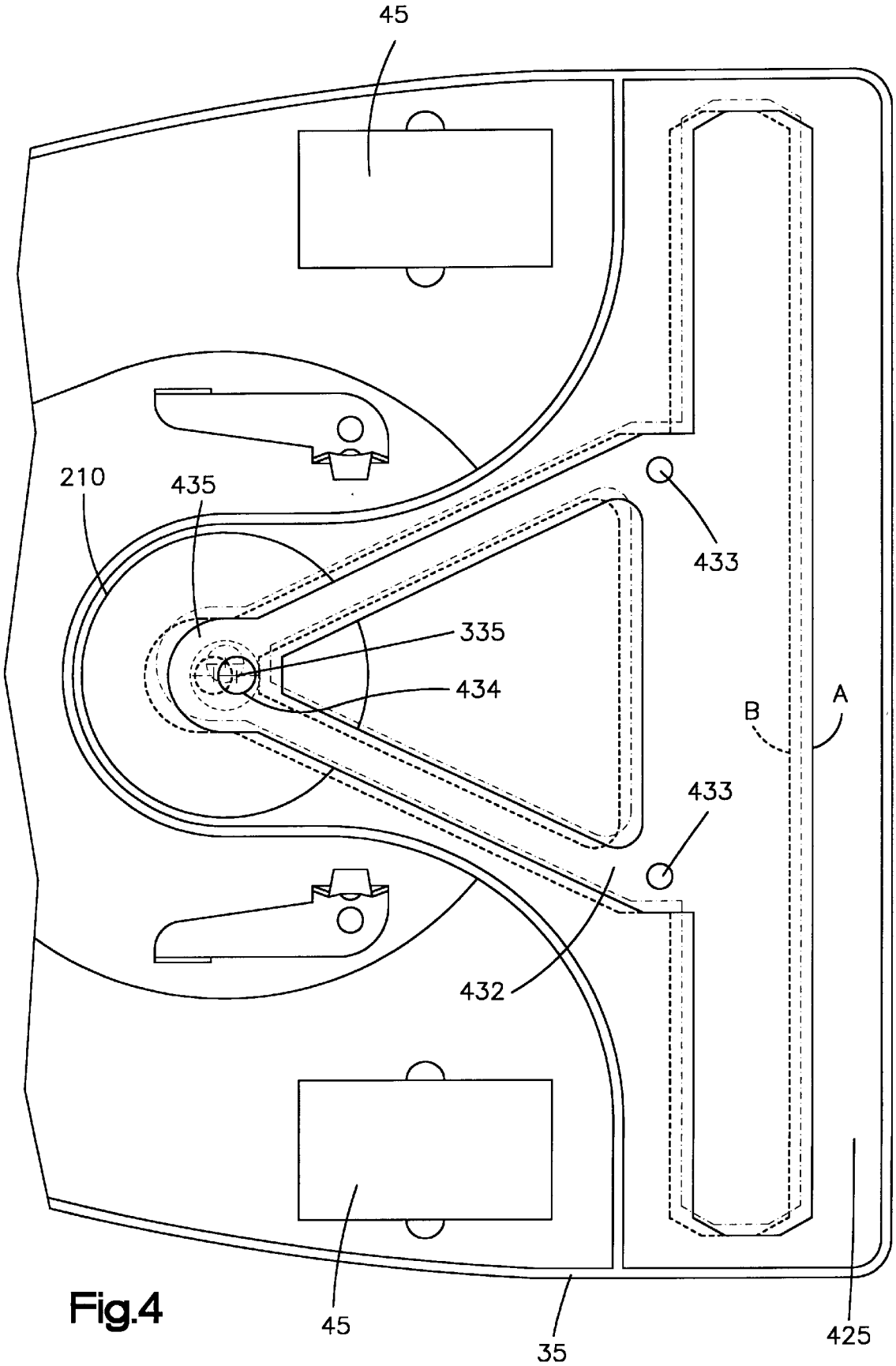
FIG. 4 is a bottom plan view of the vacuum cleaning system of FIG. 1 illustrating the motion of a carpet fiber agitating brush bar during system operation.

The brush bar drive shaft 335 is rotatably retained in a brush bar drive shaft hole 434 located at the brush bar second end 435 (FIG. 2). When the motor shaft 125 rotates, the transmission disc 338 rotates about the motor shaft axis 340. The brush bar drive shaft 335 in turn defines an eccentric orbit around the motor shaft axis 340 such that the disc 338 has a circular range of positions, two of which are designated "A" and "B" (in phantom) in FIG. 2. The brush bar 432 is thereby driven by the brush bar drive shaft 335 to define a similar orbit at its second end 435. FIG. 4 best illustrates the eccentric motion of the brush bar 432 with the solid line describing the position of the brush bar when the transmission disc 338 is in position A and the dashed line describing the position of the brush bar when the transmission disc is in position B.

Figure 5:
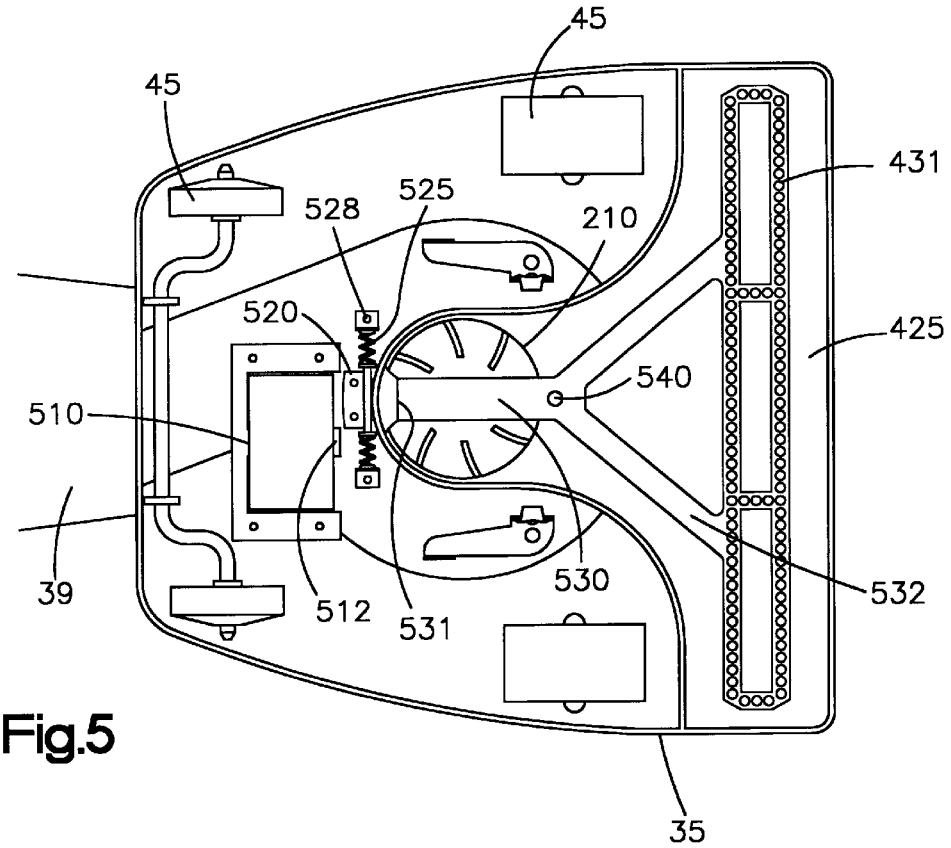
FIG. 5 is a bottom plan view of the vacuum cleaning system in accordance with another embodiment of the present invention.
Figure 6:
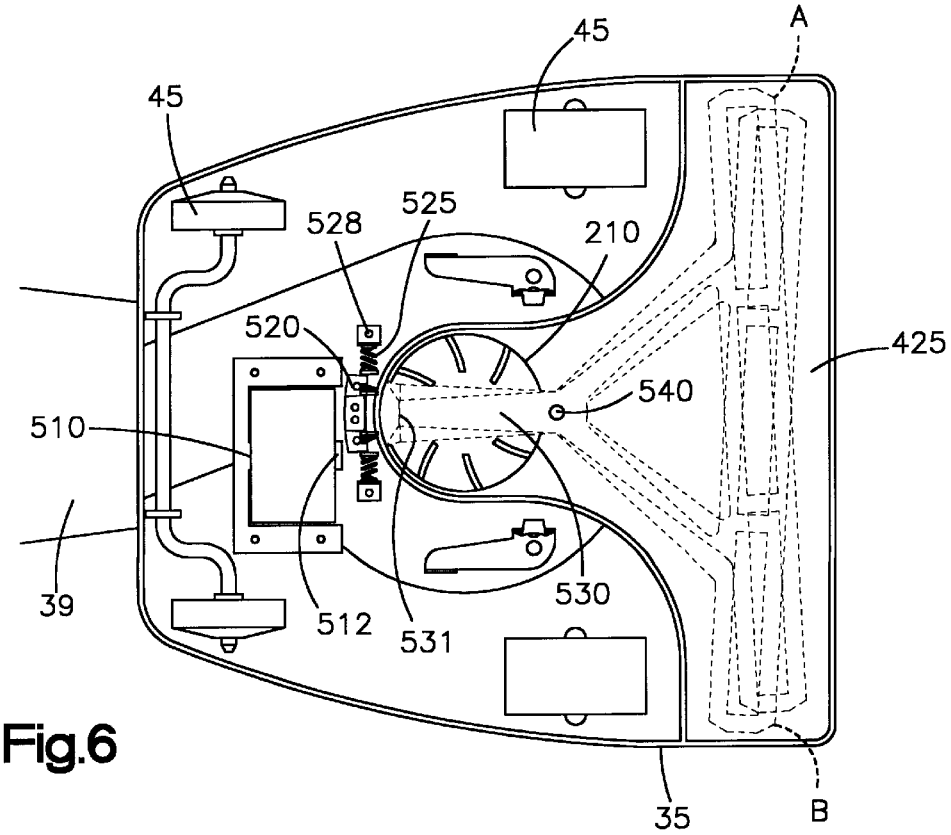
FIG. 6 is a bottom plan view of the vacuum cleaning system of FIG. 5 illustrating the motion of a carpet fiber agitating brush bar during system operation.

FIGS. 5 and 6 illustrate another embodiment, in which instead of a direct motor drive, an electromagnetic coil in conjunction with an armature is used to vibrate the brush bar. The wheels 45, electric motor (not shown), the suction producing fan 210, the dirt accumulation bag 39, the cleaner housing 35, the nozzle 425, and the brush block 431 are the same or similar to the that disclosed in FIGS. 1–4, and hence bear the same reference characters. The brush block 431 is supported within the nozzle 425 at a first end 532 of the brush bar 530. The brush bar 530 is pivotally mounted to the housing 34 by a suspension spring 540. An armature 520 which may be made of some type of steel is connected to the brush bar 530 at a second end 531. A pair of limit springs 525 are contained by bushings 528 at one end and act against the armature 520 at the other end. The limit springs limit the amount of travel the armature 520 may complete as the brush bar 530 moves about the suspension spring 540.

An electromagnetic coil 510 is mounted in the housing 35 and has a pole 512. The coil 510 is connected to the same alternating current that powers the sweeper motor (not shown). As the current cycles, most likely at 60 hertz, the coil produces an oscillating magnetic field at the pole 512. The oscillating magnetic field acts on the armature 520 to attract and then release the armature, causing it to vibrate between the limit springs 525. This vibration is translated to vibration of the brush block 431 as the brush bar 530 pivots about the suspension spring 540. FIG. 6 shows the oscillation of the brush block 431 as the armature 520 moves between a point "A" and a point "B."

When the cleaning system 20 is operating, air is sucked through the nozzle 425 by the fan 210. The carpet fiber agitating brush block 431 engages carpet fibers in a carpet on the floor to be cleaned in a vibrating manner, penetrating into the fibers to loosen dirt to be sucked into the cleaner by the fan 210 and deposited in the dirt accumulation bag 39.

It will be seen from the foregoing description that a vacuum sweeper embodying the present invention agitates the carpet fibers to aid in cleaning without pounding or pulling at the fibers, reducing carpet wear. A sweeper embodying the present invention may be less costly than those which have brush rolls. Due to reduced speed and power requirements, a pancake motor may be used, reducing the overall height and weight of the sweeper. Bearings, endcaps, and other brush roll associated parts are eliminated.

The preferred embodiments of the invention have been illustrated and described in detail. However, the present invention is not to be considered limited to the precise construction disclosed. Various adaptations, modifications and uses of the invention may occur to those skilled in the art to which the invention relates, and the intention is to cover hereby all such adaptations, modifications, and uses which fall within the spirit or scope of the appended claims.

What is claimed is:

1. A vacuum cleaning system for floors and floor coverings comprising:

a) a base member comprising a cleaner housing and floor plate, a plurality of wheels for supporting said base member above said floor, said base member defining a nozzle to be positioned in close proximity to said floor and said base member defining an air flow path between said nozzle and an accumulation bag;

b) an electric motor mounted on said base member, said motor driving a rotating motor shaft protruding therefrom, said motor shaft having a threaded end, the axis of rotation of said motor and said motor shaft being perpendicular to said floor;

c) a suction fan mechanism mounted on said base member, said fan mechanism being mechanically coupled to and rotatably driven by said motor shaft, said fan mechanism producing an air flow along said air flow path from said floor to said accumulation bag, d) a fiber agitation means comprising a plurality of brush bristles positioned within said nozzle, said agitation means moveably supported in said base member by an agitator suspension spring, said agitation means coupled to said motor shaft by an agitation transmission, said agitation transmission being directly driven by said motor shaft, said agitation transmission comprising an interiorly threaded transmission disc threadably mounted to said threaded end, said transmission disc carrying an agitation means engaging shaft eccentrically mounted with respect to said motor shaft, said agitation means engaging shaft moveably engaging said agitation means to impart limited eccentric movement to said agitation means within a plane parallel to said floor.

2. In a vacuum cleaning system including a housing having an inlet opening, an outlet opening, suction means for causing air to flow into said inlet opening and out through said outlet opening, and a brush mounted in said inlet opening for engagement with a surface to be cleaned, the improvement comprising:

a) structure mounting said brush for oscillating movement in a horizontal plane, and means for imparting oscillating movement to said brush;

b) wherein said means for imparting oscillating movement to said brush comprises a motor having a rotating shaft for driving a transmission, said transmission coupled between said motor and said brush and configured for converting the rotation of said rotating shaft into eccentric motion of said brush with respect to said rotating shaft; and c) wherein said rotating shaft has a threaded end and said transmission comprises a transmission disc threadably mounted to said rotating shaft, said transmission disc carrying an agitation means engaging shaft eccentrically mounted with respect to said rotating shaft, said engaging shaft moveably engaging said agitation means to impart limited eccentric movement to said agitation means within a plane parallel to said surface to be cleaned when said rotating shaft rotates.

3. A vacuum cleaning system for floors and floor coverings comprising:

a) a base member, means for supporting said base member above said floor, said base member defining a nozzle to be positioned in close proximity to said floor and said base member defining an air flow path between said nozzle and an accumulation means;

b) an electric motor mounted on said base member, said motor driving a rotating motor shaft protruding therefrom;

c) a suction fan mechanism mounted on said base member, said fan mechanism being mechanically coupled to and rotatably driven by said motor shaft, said fan mechanism producing an air flow along said air flow path from said floor to said accumulation means; and d) a fiber agitation means comprising a plurality of brush bristles positioned within said nozzle, said agitation means moveably supported in said base member by an agitator suspension means, said agitation means coupled to said motor shaft by an agitation transmission, said agitation transmission imparting limited eccentric movement to said agitation means within a plane parallel to said floor; and e) wherein said motor shaft has a threaded end and the axis of rotation of said motor and said motor shaft is perpendicular to said floor, and wherein said agitation transmission is directly driven by said motor shaft, said agitation transmission comprising an interiorly threaded transmission disc threadably mounted to said threaded end, said transmission disc carrying an agitation means engaging shaft eccentrically mounted with respect to said motor shaft, said agitation means engaging shaft moveably engaging said agitation means to impart limited eccentric movement to said agitation means.

4. A vacuum cleaning system for floor and floor coverings comprising:

a) a base member comprising a cleaner housing and floor plate, a plurality of wheels for supporting said base member above said floor, said base member defining a nozzle to be positioned in close proximity to said floor and said base member defining an air flow path between said nozzle and an accumulation bag;

b) an electric motor mounted on said base member, said motor driving a rotating motor shaft protruding therefrom, said motor shaft having a first end, the axis of rotation of said motor and said motor shaft being perpendicular to said floor;

c) a suction fan mechanism mounted on said base member, said fan mechanism being mechanically coupled to and rotatably driven by said motor shaft, said fan mechanism producing an air flow along said air flow path from said floor to said accumulation bag; and d) a fiber agitation means comprising a plurality of brush bristles positioned within said nozzle, said agitation means moveably supported in said base member by an agitator suspension spring, said agitation means coupled to said motor shaft by an agitation transmission, said agitation transmission being directly driven by said motor shafts, said agitation transmission comprising a transmission disc mounted to said first end, said transmission disc carrying an agitation means engaging shaft eccentrically mounted with respect to said motor shaft, said agitation means engaging shaft moveably engaging said agitation means to import limited eccentric movement to said agitation means within a plane parallel to said floor.

* * * * *